US005800229A

United States Patent [19]

Peterson

[11] Patent Number: 5,800,229

[45] Date of Patent: Sep. 1, 1998

[54] HANDLE UNIT FOR BUOYANT AQUATIC DEVICES

[75] Inventor: Leroy L. Peterson, Omaha, Nebr.

[73] Assignee: Sportsstuff, Inc., Omaha, Nebr.

[21] Appl. No.: 606,114

[22] Filed: Feb. 23, 1996

[51] Int. Cl.[6] ..... B63C 9/08

[52] U.S. Cl. ..... 441/129; 441/136; 16/110.5

[58] Field of Search ..... 441/74, 129, 130–132, 441/136; 114/270, 221 R; 16/110 R, 110.5; 312/320, 204

[56] References Cited

U.S. PATENT DOCUMENTS 4,571,195 2/1986 Brooks et al. ..... 441/74

*Primary Examiner*—Jesus D. Sotelo

*Attorney, Agent, or Firm*—Henderson & Sturm

[57] ABSTRACT

A handle unit for rafts, towables, and other buoyant water sports equipment which is recessed within the interior of the device and therefore provides a relatively smooth surface, eliminating the dangers of injury from protruding handles. The handgrips are fabricated from polyvinylchloride (PVC) or other material having similar properties and comprise a flat disk member having an enlarged aperture secured at its lower surface to a cup-shaped receptacle member. The periphery of the disk member is then thermosealed or glued to the exterior skin of the aquatic device with the cup-shaped member extending within the interior of the aquatic device. The enlarged aperture of the handle unit is of sufficient size to receive the fingers of the user. An enlarged downwardly depending lip surrounding the aperture facilitates gripping of the handle unit.

14 Claims, 2 Drawing Sheets

HANDLE UNIT FOR BUOYANT AQUATIC DEVICES

TECHNICAL ADVICE

This invention relates to handle units, and more particularly to handle units especially designed for buoyant aquatic devices such as rafts, floats, towables, and other water recreation devices.

BACKGROUND ART

Rafts, floats, towables, and other water recreation devices are often equipped with plastic or hard-rubber handles which are secured to the exterior surface of the device to offer the user of the device assistance in climbing in and out, and also to help the user hold on during a rough ride or when being towed behind a motor boat. These handles are less than satisfactory in that they protrude from the surface of the device and therefore are prone to gouge and poke a swimmer entering or exiting the device or when a rider is thrown about the device.

DISCLOSURE OF THE INVENTION

The present invention discloses a handle unit for rafts, towables, and other buoyant water sports equipment which is recessed within the interior of the device and therefore provides a relatively smooth surface, eliminating the dangers of injury from protruding handles. The handgrip are fabricated from polyvinylchloride (PVC) or other material having similar properties and comprise a flat disk member having an enlarged aperture secured at its lower surface to a cup-shaped receptacle member. The periphery of the disk member is then thermosealed or glued to the exterior skin of the aquatic device with the cup-shaped member extending within the interior of the aquatic device. The enlarged aperture of the handle unit is of sufficient size to receive the fingers of the user. An enlarged downwardly depending lip surrounding the aperture facilitates gripping of the handle unit.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
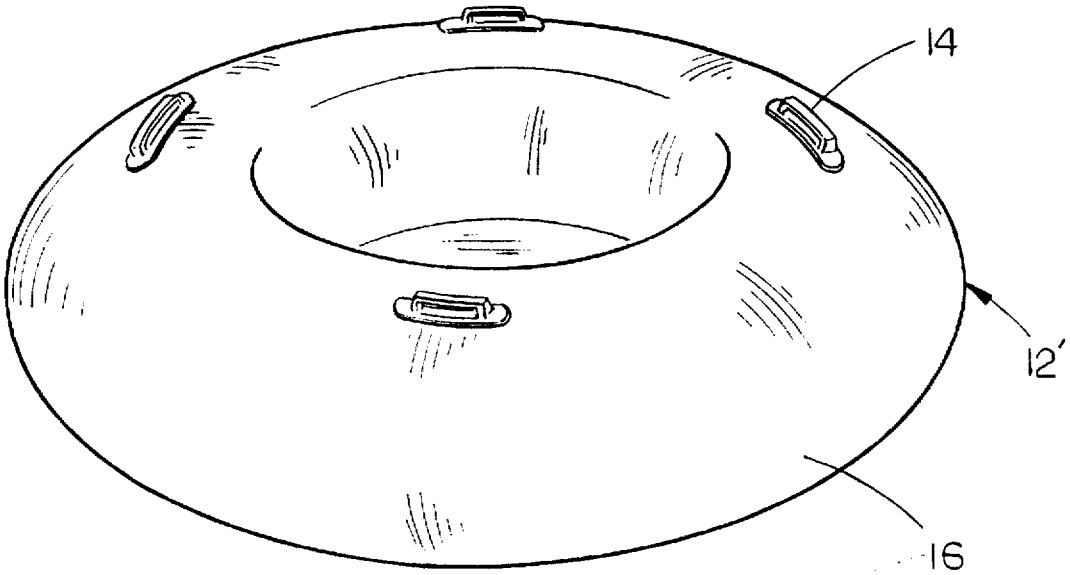
FIG. 1 (PRIOR ART)
FIG. 1 is a perspective view of an aquatic device with the protruding handles of the prior art.

Referring now to the drawings, wherein like reference numerals designate identical or corresponding parts throughout the several views, FIG. 1 depicts a typical buoyant aquatic device 12' utilizing the protruding handles 14 of the prior art. These handles 14 are generally made from hard plastic and are secured to the exterior skin 16 of the device where they are accessible as handholds and as aids for entering or exiting the device.

Figure 2:
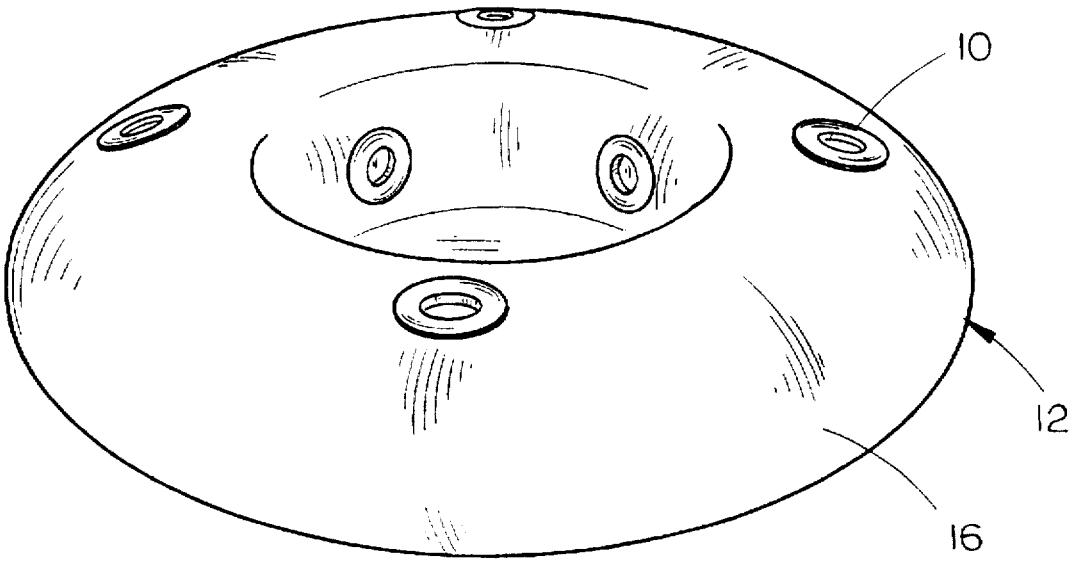
FIG. 2 is a perspective view of an aquatic device utilizing the handle units of the present invention.

FIG. 2 depicts the handle units 10 of the present invention as they may be positioned on a typical buoyant aquatic device 12. The aquatic devices 12 for which the handle units 10 are designed include inflatable devices having an exterior skin 16 enclosing a hollow interior, as well as aquatic devices enclosing any number of buoyant materials which cause the device to float.

Figure 3:
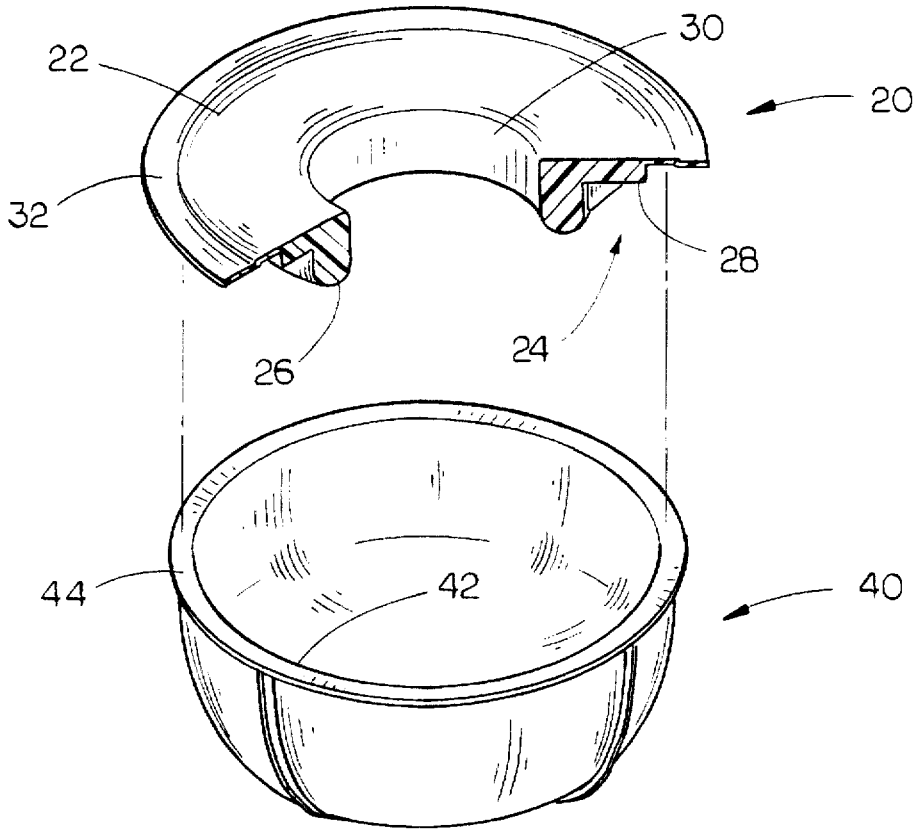
FIG. 3 is an exploded, perspective view of the present invention.
Figure 4:
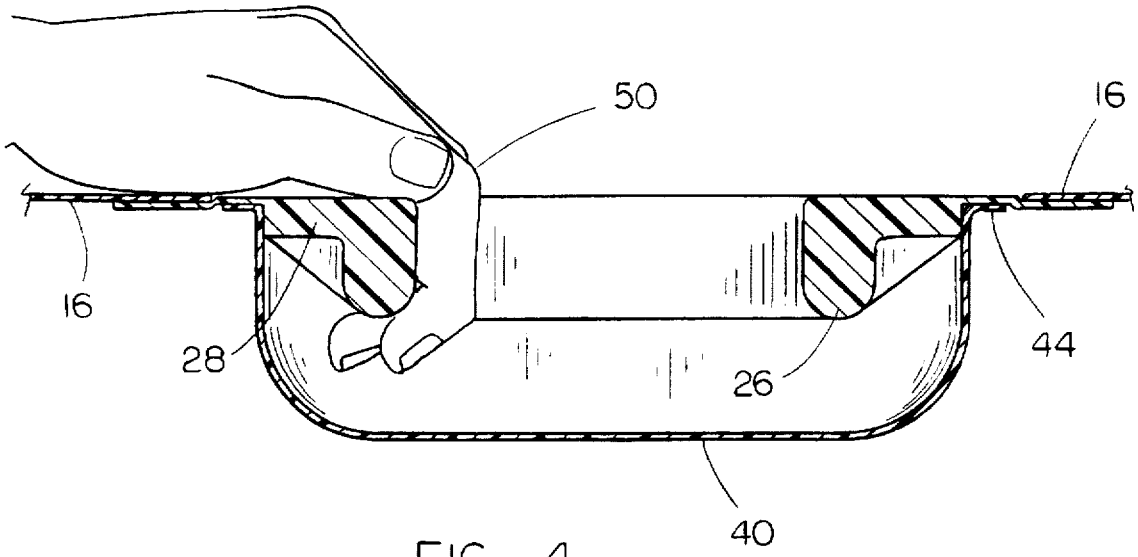
FIG. 4 is a cross-sectional view of the handle unit of the present invention affixed to a buoyant aquatic device.

Referring now to FIG. 3 and FIG. 4, the handle unit 10 may be seen to comprise a disk member 20 and a cup-shaped receptacle member 40, fabricated from polyvinylchloride, plastic, or other suitable material. The disk member 20 is seen to have a generally flat upper surface 22 with a large central aperture 30 and a contoured lower surface 24. The contoured lower surface 24 includes a downwardly depending lip portion 26 and a stepped shoulder 28 extending radially outwardly from the lip portion 26, the combination of which greatly facilitates grasping of the handle unit 10 by the fingers 50 of a user of the aquatic device.

The cup-shaped receptacle member 40 includes a rim 42 with an outwardly protruding lip element 44. As seen in FIG. 4, the receptacle member 40 is thermosealed or glued to the lower surface of the disk member 20, with the rim 42 engaging the shoulder 28 and the lip element 44 engaging the periphery 32.

After the disk member 20 and receptacle member 40 are secured together to form the handle unit 10, the handle unit 10 is then thermosealed or glued within an aperture in the exterior skin 16 of the aquatic device 12.

Those skilled in the art will recognize that many modifications and variations of the present invention are possible in light of the above teachings. It is therefore to be understood that, within the scope of the appended claims, the invention may be practiced otherwise than as specifically described.

What is claimed is:

1. A handle unit for a buoyant aquatic device having an outer skin, wherein the handle unit comprises:

an enlarged disk member having a generally flat top surface, a central aperture, and a contoured bottom surface; and a receptacle member operatively associated with the bottom surface of the disk member to define an interior chamber dimensioned to receive a user's fingers.

2. The handle unit as recited in claim 1 wherein the enlarged disk member is disposed in a flush fashion relative to the outer skin of the aquatic device.

3. The handle unit as recited in claim 1 wherein the contoured bottom surface includes an enlarged downwardly depending lip portion surrounding the central aperture.

4. The handle unit as recited in claim 3 wherein the contoured bottom surface further includes a stepped shoulder portion extending radially outwardly from the lip portion.

5. The handle unit as recited in claim 4 wherein the outer periphery of the disk member has a generally thin, flat configuration.

6. The handle unit as recited in claim 4 wherein the receptacle member engages the periphery of the stepped shoulder portion of the bottom surface of the disk member.

7. A handle unit for an aquatic device having an outer skin, wherein the handle unit comprises:

a generally shallow receptacle member having a rim with an outwardly projecting lip element; and an apertured disk member disposed in an overlapping relationship relative to the receptacle member.

8. The handle unit as recited in claim 7 wherein the disk member is provided with an enlarged central aperture.

9. The handle unit as recited in claim 7 wherein the disk member is disposed in a flush fashion relative to the outer skin of the aquatic device.

10. The handle unit as recited in claim 7 wherein the disk member has a generally flat top surface and a contoured bottom surface.

11. The handle unit as recited in claim 10 wherein the contoured bottom surface includes an enlarged, downwardly depending lip portion surrounding the central aperture.

12. The handle unit as recited in claim 11 wherein the contoured bottom surface further includes a stepped shoulder portion extending radially outwardly from the lip portion.

13. The handle unit as recited in claim 12 wherein the outer periphery of the disk member has a generally thin flat configuration.

14. The handle unit as recited in claim 12 wherein the receptacle member engages the periphery of the stepped shoulder portion of the bottom surface of the disk member.

* * * * *